United States Patent [19]

Borthwick et al.

[11] 4,033,359

[45] * July 5, 1977

[54] SMOKING MIXTURE

[75] Inventors: James Borthwick, Glasgow; James Forrester Morman, Troon, both of Scotland

[73] Assignee: Imperial Chemical Industries Limited, London, England

[ * ] Notice: The portion of the term of this patent subsequent to May 27, 1992, has been disclaimed.

[22] Filed: Mar. 5, 1974

[21] Appl. No.: 448,356

Related U.S. Application Data

[63] Continuation of Ser. No. 125,809, March 18, 1971, abandoned.

[30] Foreign Application Priority Data

Mar. 23, 1970 United Kingdom ..... 13866/70

[52] U.S. Cl. ..... 131/17 AC

[51] Int. Cl.[2] ..... A24B 3/14

[58] Field of Search ..... 131/2, 17, 15, 140–144

[56] References Cited

UNITED STATES PATENTS

| | | | |
|---|---|---|---|
| 2,592,550 | 4/1952 | Frankenburg | 131/17 AC |
| 2,809,904 | 10/1957 | Koree | 131/2 |
| 2,930,720 | 3/1960 | Finberg | 131/17 |
| 3,003,899 | 10/1961 | Grunwald | 131/17 R |
| 3,025,860 | 3/1962 | Grossteinbeck et al. | 131/140 C |
| 3,447,534 | 6/1969 | Briskin et al. | 131/2 |
| 3,461,878 | 8/1969 | Kirkland | 131/2 |
| 3,477,865 | 11/1969 | Armbrust et al. | 131/17 X |
| 3,529,602 | 9/1970 | Hind et al. | 131/2 |
| 3,545,449 | 12/1970 | Morman et al. | 131/2 |
| 3,885,574 | 5/1975 | Borthwick et al. | 131/2 |

*Primary Examiner*—Kyle L. Howell
*Assistant Examiner*—V. Millin
*Attorney, Agent, or Firm*—Cushman, Darby & Cushman

[57] ABSTRACT

Tobacco based smoking mixture containing a minimum amount of tobacco and a maximum amount of harmless inorganic filler, the composition of the filler having been selected so as to impart a commercially acceptable burning rate to the mixture.

11 Claims, No Drawings

SMOKING MIXTURE

This is a continuation of application Ser. No. 125,809 filed Mar. 18, 1971, now abandoned.

This invention relates to smoking mixtures and to methods of producing such mixtures.

Our co-pending U.K. Patent Application No. 13860/70 relates to smoking mixtures which contain a minimum amount of organic combustible material as smoke-producing fuel and a maximum amount of inorganic filler as combustion modifier. In such a mixture the combustion modifying properties of the inorganic fillers are utilised to attain a reduction of any health hazard chemicals which arise from combustion of the organic fuel. The mixtures are tobacco-substitute based and the organic materials comprising the tobacco substitutes include carbohydrate, modified carbohydrate, certain aldol condensation products and carbon samples which produce lower amounts of polycyclic aromatic hydrocarbons.

We have discovered that the underlying principle of the invention of our said co-pending Application can also be applied to tobacco based smoking mixtures.

Accordingly, the present invention is a smoking mixture comprising tobacco in admixture with a harmless inorganic filler and a binder, the inorganic filler being present in quantities such as to considerably reduce the amount of harmful products produced on combustion of the mixture and the composition of the filler having been selected by balancing its ion content so as to impart a commercially acceptable burning rate to the smoking mixture.

The tobacco content of the mixture may be 15 to 80% by weight of the mixture, preferably 20–30% by weight.

The harmless inorganic filler may comprise 15 to 65 by weight of the smoking mixture, preferably 40 to 60% by weight.

The smoking mixture may also contain a plasticiser/-humectant in addition to the binder.

The present invention is also a method of manufacturing the aforesaid smoking mixture comprising preselecting a specific weight of tobacco which lies between 15 to 80% of the total weight of the mixture, admixing said tobacco with 15 to 65% by weight of a predetermined filler the ionic content of which has been balanced to impart a commercially acceptable burning rate to the mixture and finally forming a shaped article of the mixture utilising a binder.

The shaped article is preferably a film, extruded filament or tape.

For the purpose of this specification the term "harmless inorganic filler" is intended to include inorganic salts of some relatively simple organic acids. For example, formates, oxalates, tartrates and citrates can be used as "harmless inorganic fillers" but these are less satisfactory than the preferred completely inorganic materials on account of some undesirable pyrolytic decomposition. This decomposition becomes potentially more harmful as the size of the organic molecule increases.

The inorganic filler preferably comprises a mixture of two or more such inorganic salts admixed in quantities such as to obtain the balance of anions and cations most appropriate for imparting the desired rate of combustion to the preselected amount of tobacco in the mixture.

Although the balance of ions is advantageously obtained by varying the respective amounts of two or more inorganic salts, it is possible to attain the desired rate of combustion using an optimum amount of single inorganic salt as inert filler.

An acceptable rate of combustion is considered to be 10–12 puffs from a machine made cigarette containing 1.1 g. of the smoking mixture of the invention, which puff count corresponds to that of a standard class B British cigarette containing 1.1 g. tobacco where each puff is of 25 ml. volume in two seconds, followed by a 58 second rest or smouldering period and where the 70 mm. cigarette is smoked to a butt length of 20 mm.

Additives can advantageously be included in the smoking mixture of the invention, which additives include ingredients such as are normally used in smoking mixtures, for example materials to improve ash coherence and colour, flavourants, drugs and medicaments.

Such a smoking mixture containing a high content of inorganic material can advantageously be produced by a process similar to reconstituted tobacco processes which utilise film-forming agents or binders. This enables a relatively large proportion of inorganic material to be incorporated in the smoking mixture.

The film-forming agent or binder and the plasticiser/-humectant incorporated in the mixture may be selected from those commonly used in the reconstituted tobacco art.

Preferred binders include carboxymethyl cellulose and its salts and other carboxylated carbohydrates. Where the amount of binder employed is very small, other less satisfactory binder materials such as natural gums, guar gums, locust bean gums and other synthetic binders such as methyl and other ethers of cellulose may be used.

Preferred plasticiser/humectants include glycerol, ethylene glycol and polyethylene glycol.

As indicated above, the choice of the harmless inorganic fillers to be incorporated in the smoking mixture determines the rate of combustion or how many normal puffs can be had from a given weight of the mixture. The art of making an acceptable burning composition involves choosing the correct proportions of fillers which relatively promote or retard the combustion. Hydrate and nonhydrated versions of the same salt can be used.

The art of retarding combustion without making a composition glowproof yet obtaining the correct puff count from a given weight of smoking mixture by the use of these inert fillers is another key to the success of the invention. Combustion accelerators are combined with combustion retardants in proportions which give a desirable rate of combustion for a particular tobacco and a particular amount thereof incoporated in the mixture. Whilst this principle is exemplified herein and also in our co-pending U.K. Patent Application No. 13860/70 with reference to commonly available inorganic fillers, it can be applied to any inorganic material which proves to be a safe filler for use in a smoking mixture. We have found that a number of commonly available acidic anions influence combustion rate and the order of the retarding ability of a section of them is formate <oxalate<silicate <carbonate=chloride <sulphate<phosphate<borate. Isolated exceptions to these orders indicated can, however, be found. Amongst the cations the order is sodium potassium<calcium<magnesium. With the cations it would appear that their effect on the burning rate depends on their basicity, the most significant change being from calcium to magnesium. This implies, for example, that in smoking mixtures which are identical except that A contains sodium sulphate and B contains the same proportion by weight of magnesium sulphate, A will burn away more quickly. Similarly, in two compositions identical except that A contains calcium carbonate and B contains calcium borate, composition A will burn away more quickly than composition B.

The fillers chosen should not have the power to retain excessive quantities of water, otherwise glowproofing will result.

It is preferable, but not essential, that the fillers should be insoluble in water. Calcium carbonate has been found to be a most useful agent for use as a combustion accelerator balanced against combustion retarding agents such as calcium orthophosphate ($CaHPO_4,2H_2O$), magnesite ($MgCO_3$), light basic magnesium carbonate ($3MgCO_3).Mg(OH)_23H_2O$), and calcium sulphate ($CaSO_4.½H_2O$). Using these and other inorganic materials, film can be made which give shred with filling powers comparable to 100% tobacco shred.

The main advantage of the smoking mixtures of the invention is that the lower amounts of tobacco present mean that proportionately lower amounts of the harmful smoke products are formed whilst maintaining a desirable rate of combustion for the mixture. In this connection, tests carried out on smoking mixtures of the invention show a reduction in the benzpyrene and other harmful chemicals content of the smoke because of the reduced tobacco content.

The principle of ion balancing of the inert fillers is the same as described in our co-pending U.K. Patent Application No. 13860/70 and as illustrated in Tables 1 to 9 of said Application. According to this principle the amount of tobacco to be used in the mixture is first selected and then ion balance tests are effected to determine the composition having the most desirable rate of combustion. As can be seen from said Tables 1 to 9, the ions are investigated separately in order to ascertain their relative suitabilities.

The technique of arriving at the composition of a suitable tobacco-based smoking mixture is illustrated in the Table below. Experiments to arrive at the correct puff number employed the technique of balancing the calcium carbonate against the light basic magnesium carbonate content of the mixture. The Table shows that in this instance light basic magnesium carbonate caused glowproofing. The composition listed in the extreme left hand column of this Table constitutes Example 1 of a smoking mixture according to the present invention.

| Composition | Percentage by weight | | | | | |
|---|---|---|---|---|---|---|
| Tobacco | 28 | 28 | 28 | 28 | 28 | 28 |
| SCMC | 10 | 10 | 10 | 10 | 10 | 10 |
| Glycerol | 14 | 14 | 14 | 14 | 14 | 14 |
| $CaCO_3$ | 35 | 33 | 31 | 29 | 27 | 25 |
| $3MgCO_3.Mg(OH)_2.3H_2O$ | — | 2 | 4 | 6 | 8 | 10 |
| K citrate | 4 | 4 | 4 | 4 | 4 | 4 |
| Citric acid | 4 | 4 | 4 | 4 | 4 | 4 |
| $(NH_4)_2SO_4$ | 5 | 5 | 5 | 5 | 5 | 5 |
| Puff Number | 11–12 | Extinguished after 3–4 puffs | Would not remain alight | Would not remain alight | Would not light properly | Would not burn |
| | Correct Puff Number | → | | | | Glow-proofed |

Cigarettes made with the paper used by United Kingdom cigarette manufacturers

The composition of further Examples 2 and 3 of the invention were arrived at by a similar process but in these cases it was possible to utilize even higher proportions of inorganic material by balancing calcium carbonate against magnesite. In Example 3 locust bean gum binder is used. Examples 4 to 9 illustrate further variations in the parameters of the invention.

EXAMPLE 1

4.7 parts ball-milled, flue-cured Virgina type tobacco, 5.8 parts calcium carbonate were suspended in 62.7 parts of water with stirring. 0.7 part potassium citrate, 0.8 part citric acid, 0.9 part ammonium sulphate and 2.3 parts glycerol were dissolved in 20.8 parts of water and added to the tobacco, chalk suspension. After ½ hour mixing 1.7 parts sodium carboxymethyl cellulose were added to the mixture and the whole mixed for a further hour.

The slurry was spread at 0.012 inches on a band drier and dried using overband heating at 150° C. The band speed was from 25–30 ft./min. The film material was satisfactorily shredded and processed in tobacco machinery. 1.1 g. cigarettes gave 10 puffs. The smoke was mild to taste.

The dry weight composition of Example 1 as indicated in the above Table was:

| | % |
|---|---|
| Ball-milled flue-cured, Virginia type tobacco | 28 |
| SCMC | 10 |
| Glycerol | 14 |
| $CaCO_3$ | 35 |
| Potassium citrate | 4 |
| Citric acid | 4 |
| $(NH_4)_2SO_4$ | 5 |

EXAMPLE 2

3.9 parts tobacco rag were added to 75 parts of water and allowed to soak for 30 minutes. The mixture was then stirred and 5.3 parts of calcium carbonate, 1.0 part magnesite, 0.6 part potassium citrate, 0.6 part ammonium sulphate, 0.7 part citric acid and 1.0 part glycerol were added and the mixing continued for 10 minutes. The suspension was transferred to a Probst and Class mill and with a gap setting of 2 milled for 10 minutes. The gap setting was reduced to zero and the mixture milled for 10 minutes, at the end of which time 1.1 parts sodium carboxymethyl cellulose were added and the slurry discharged into a container. The slurry was stirred for 15 minutes and 11 parts of water added to reduce the viscosity of 80,000 cps.

Film material was prepared on a 4 zone conventional band drier using overband heating at 150° C and underband heating on last 3 zones with slurry spread at 0.030 in. and band speed of 12 ft./min.

The film material was shredded and processed satisfactorily on cigarette making machinery.

1.1 g. cigarettes gave 10 puffs. The smoke was mild to taste.

The dry weight composition of Example 2 was:

| | % |
|---|---|
| Tobacco | 27.5 |
| $CaCO_3$ | 37.2 |
| $MgCO_3$ | 7.0 |
| Potassium citrate | 4.3 |
| $(NH_4)_2SO_4$ | 4.3 |
| Citric acid | 4.9 |
| Glycerol | 7.0 |
| SCMC | 7.8 |

EXAMPLE 3

9.6 parts tobacco rag were added to 45.6 parts of water and allowed to soak for 15 minutes, after which time the mixture was transferred to a Probst and Class mill and milled at setting 3 for 10 minutes. The suspension was returned to the stirrer and after the addition of 13.7 parts calcium carbonate, 1.4 parts potassium citrate, 1.4 parts ammonium sulphate, 2.4 parts glycerol, 2.4 parts magnesite and 1.7 parts citric acid, it was stirred for 30 minutes. The batch was then processed in the mill, again at gap setting 2, for 5 minutes and at gap setting zero for 5 minutes. 1.7 parts of locust bean gun and 7.5 parts of water were added at this stage. The slurry was discharged immediately after dispersion of the locust bean gum into a container and stirred for a further 20 minutes. 12.7 parts of water were added to reduce the viscosity to 30,000 cps.

The slurry was spread at 0.02 in. gap on a band drier and film made using a combination of overband hot air at 150° C and steam underband heating. The band speed was 24 ft./min.

The film was satisfactorily shredded and processed in cigarette making machinery. 1.1 g. cigarettes gave 10 puffs. The smoke was mild to taste.

The dry weight composition of Example 3 was:

| | % |
|---|---|
| Tobacco | 28 |
| $CaCO_3$ | 40 |
| $MgCO_3$ | 7 |
| $(NH_4)_2SO_4$ | 4 |
| Potassium citrate | 4 |
| Citric acid | 5 |
| Glycerol | 7 |
| Locust bean gum | 5 |

EXAMPLE 4

2.04 parts glycerol and 1.17 parts potassium citrate were dissolved in 150 mls. of water. 2.88 parts SCMC were then added to the solution and stirred for 15 minutes. 6.0 parts ball milled, flue cured Virgina tobacco; 6.6 parts powdered chalk and 11.31 parts magnesium carbonate were mixed together in the dry state, then added to the previous mixture. The whole was stirred for 1 hour.

Film material was made by spreading the slurry at 0.02 inches on glass plates and left to dry. The film material was humidified and shredded.

Ten cigarettes were hand rolled with Imperial Verge paper. 1.1 g. cigarettes gave 12 standard puffs. The smoke was mild to taste.

Dry weight composition:

| | % |
|---|---|
| Virginia Tobacco | 20.0 |
| Glycerol | 6.8 |
| SCMC | 9.6 |
| $CaCO_3$ | 22.0 |
| $MgCO_3$ | 37.7 |
| Potassium citrate | 3.9 |

EXAMPLE 5

0.9 parts glycerol were dissolved in 150 mls. of water. 2.1 parts SCMC were then added to the solution and stirred for 15 minutes. 7.5 parts flue cured, ball milled Virginia Tobacco; 4.8 parts sodium silicate and 14.7 parts calcium oxalate were mixed together in the dry state, then added to the previous mixture. The whole was stirred for 1 hour.

Film material was made by spreading the slurry at 0.02 inches on glass plates and left to dry. The film material was humidified and shredded.

Ten cigrettes were hand rolled with Imperial Verge paper. 1.1 g. cigarettes gave 10 standard puffs. The smoke was mild to taste.

Dry weight composition:

| | % |
|---|---|
| Virginia Tobacco | 25.0 |
| Glycerol | 3.0 |
| SCMC | 7.0 |
| Sodium silicate | 16.0 |
| Calcium oxalate | 49.0 |

EXAMPLE 6

2.1 parts glycerol, 1.2 parts ammonium sulphate; 1.2 parts potassium citrate and 1.5 parts citric acid were dissolved in 150 mls. of water. 1.5 parts sodium alginate were then added to the solution and stirred for 15 minutes. 2.1 parts magnesium carbonate; 12.0 parts powdered chalk and 8.4 ball-milled, flue cured virginia tobacco were mixed together in the dry state, then added to the previous mixture. The whole was stirred for 1 hour.

Film material was made by spreading the slurry at 0.02 inches on glass plates and left to dry. The film material was humidified and shredded. Ten cigarettes were hand rolled with Imperial Verge paper. 1.1 g. cigarettes gave 11 standard puffs. The smoke was mild to taste.

Dry weight composition:

| | % |
|---|---|
| Virginia Tobacco | 28.0 |
| Glycerol | 7.0 |
| Sodium alginate | 5.0 |
| $CaCO_3$ | 40.0 |
| $MgCO_3$ | 7.0 |

-continued

| | % |
|---|---|
| Potassium citrate | 4.0 |
| $(NH_4)_2SO_4$ | 4.0 |
| Citric Acid | 5.0 |

EXAMPLE 7

A smoking mixture having the dry weight composition listed below was prepared in a manner similar to that of Examples 1 to 7

| | % |
|---|---|
| Tobacco | 60.0 |
| SCMC | 10.0 |
| Glycerol | 10.0 |
| Potassium Citrate | 3.9 |
| $CaCO_3$ | 12.4 |
| $MgCO_3$ | 3.7 |

1.1 g. hand rolled cigarettes (Imperial Verge Paper) gave 14 standard puffs. The smoke was mild to taste.

EXAMPLE 8

A smoking mixture having the dry weight composition listed below was prepared in a manner similar to that of Examples 1 to 7

1.1 g. hand rolled cigarettes (Imperial Verge Paper) gave 16 standard puffs. The smoke was mild to taste.

EXAMPLE 9

A smoking mixture having the dry weight compositions listed below was prepared in a manner similar to that of Examples 1 to 7

| | % |
|---|---|
| Tobacco | 60.0 |
| SCMC | 10.0 |
| Glycerol | 10.0 |
| Potassium Citrate | 3.9 |
| $CaCO_3$ | 16.10 |

1.1 g. hand rolled cigarettes (Imperial Verge Paper) gave 15 standard puffs. The smoke was mild to taste.

What we claim is:

1. A smoking mixture in fabricated form comprising
   a. 15–60% by weight of tobacco, based on the weight of said mixture,
   b. binder in amount sufficient to fabricate this mixture into the desired form, and
   c. from 40 to 65% by weight of a harmless filler, the combination of cations and anions in the filler being such that the smoking mixture has a puff number of 10–12. determined by subjecting a 1.1 g cigarette 70 mm long and 25 mm in circumference to a smoking procedure with puffs of 25 ml in 2 seconds followed by a 58 second rest period and the cigarette smoked down to a butt length of 20 mm, the anion of the filler being formate, oxalate, citrate, tartrate, silicate, carbonate, chloride, sulphate, phosphate, borate, oxide, dioxide or aluminate and the cation of the filler being sodium, potassium, calcium, magnesium, iron or titanium.

2. A smoking mixture as claimed in claim 1 wherein the tobacco content of the mixture is 20 to 30% by weight.

3. A smoking mixture as claimed in claim 1 wherein the harmless filler comprises 40 to 60% by weight of the smoking mixture.

4. A smoking mixture as claimed in claim 1 wherein the filler comprises a mixture of two or more inorganic salts admixed in quantities such as to obtain the balance of anions and cations most appropriate for imparting an acceptable rate of combustion to the smoking mixture.

5. A smoking mixture as claimed in claim 1 wherein the filler comprises a single inorganic salt present in an amount such as to obtain an acceptable rate of combustion for the smoking mixture.

6. A smoking mixture as claimed in claim 1 wherein the filler comprises a salt of an organic acid.

7. A smoking mixture as claimed in claim 1 comprising a plasticiser/humectant in addition to the binder.

8. A smoking mixture as claimed in claim 7 wherein the plasticiser/humectant comprises glycerol, ethylene glycol or polyethylene glycol.

9. A smoking mixture as claimed in claim 1 wherein the binder is selected from the group consisting of carboxymethyl cellulose and its salts, other carboxylated carbohydrates, natural gum, guar gum, locust bean gum and cellulose ethers.

10. A smoking mixture as claimed in claim 1 comprising, medicaments, flavourants, drugs and other known additives.

11. A smoking mixture as claimed in claim 1 wherein the inorganic filler comprises calcium carbonate, calcium borate, sodium borate, calcium orthophosphate, magnesium carbonate, calcium sulphate, calcium oxalate, iron sulphate, titanium dioxide, magnesium aluminate or sodium aluminium silicate or mixtures thereof.

* * * * *